United States Patent [19]

Ueda

[11] Patent Number: 5,034,270

[45] Date of Patent: Jul. 23, 1991

[54] BASE FOR COATING MATERIAL MADE OF SYNTHETIC RESIN

[75] Inventor: Hirofumi Ueda, Tokyo, Japan

[73] Assignees: Kabushiki Kaisha Raser; Sumitomo Rubber Industries, Ltd., both of Tokyo, Japan

[21] Appl. No.: 292,660

[22] Filed: Dec. 21, 1988

Related U.S. Application Data

[63] Continuation of Ser. No. 83,517, Aug. 5, 1987, abandoned.

[30] Foreign Application Priority Data

Aug. 7, 1986 [JP] Japan ..... 61-184218

[51] Int. Cl.[5] ..... B32B 3/06; E04C 2/04

[52] U.S. Cl. ..... 428/306.6; 52/309.9; 52/309.12; 52/309.17; 428/139; 428/307.3; 428/312.4; 428/323; 428/325; 524/2

[58] Field of Search ..... 428/139, 306.6, 307.3, 428/312.2, 312.4, 323, 325, 688; 52/250, 309.9, 309.12, 309.17, 310, 577; 524/2, 59

[56] References Cited

U.S. PATENT DOCUMENTS

| | | | |
|---|---|---|---|
| 2,008,718 | 7/1935 | Jenkins | 428/312.4 |
| 3,021,291 | 2/1962 | Thiessen | 428/703 |
| 3,870,553 | 3/1975 | Hussey | 428/312.4 |
| 3,909,144 | 9/1975 | Garn et al. | 428/703 |
| 4,112,176 | 9/1978 | Bailey | 428/304 |
| 4,349,398 | 9/1982 | Kearns et al. | 156/71 |
| 4,351,867 | 9/1982 | Mulvey et al. | 428/703 |
| 4,392,335 | 7/1983 | Heiman | 428/703 |
| 4,477,533 | 10/1984 | Phillips | 428/703 |
| 4,559,263 | 12/1985 | Roodvoets | 428/703 |
| 4,562,109 | 12/1985 | Harvey et al. | 428/703 |
| 4,647,496 | 3/1987 | Lehnert et al. | 428/703 |

FOREIGN PATENT DOCUMENTS

| | | | |
|---|---|---|---|
| 1254627 | 1/1961 | France . | |
| 1259487 | 3/1961 | France . | |
| 2066068 | 8/1971 | France . | |
| 2365660 | 9/1976 | France . | |
| 2378918 | 8/1978 | France . | |
| 0052429 | 4/1977 | Japan | 428/703 |
| 57-27955 | 2/1982 | Japan | 524/8 |
| 7903098 | 10/1980 | Netherlands | 524/8 |
| 545378 | 12/1973 | Switzerland . | |
| 863413 | 3/1961 | United Kingdom . | |
| 1218789 | 1/1971 | United Kingdom | 428/703 |

*Primary Examiner*—George F. Lesmes
*Assistant Examiner*—Christopher Brown
*Attorney, Agent, or Firm*—Ware, Fressola, van der Sluys & Adolphson

[57] ABSTRACT

A base according to the present invention for defining a surface to be coated by liquid synthetic resin used for finishing a floor, comprises a porous plate, or the plate and a spacer bonded to a porous plate, the spacer having at least one hollow portion communicating to holes in the plate.

19 Claims, 1 Drawing Sheet

BASE FOR COATING MATERIAL MADE OF SYNTHETIC RESIN

This is a continuation of co-pending application Ser. No. 07/083,517, now abandoned, filed on Aug. 5, 1987.

BACKGROUND OF THE INVENTION

1. Field of the Invention

This invention relates to a base for a coating material made of synthetic resin.

2. Description of the Prior Art

Conventionally, in the execution of a plastic flooring, the floor for example, may be finished by applying a coating material (flooring material) made of liquid synthetic resin such as urethane, epoxy or the like directly to a floor base made of concrete, i.e., concrete base. A film or layer of the coating material is successively hardened from its outer surface thereof contacting the air toward its back contacting the concrete base with the passage of time to form a floor surface.

Now, it has been pointed out that the film or layer of the coating material directly applied to the concrete base often produce defects such as pinholes opening to the surface of the film and blisters swelled up on the surface.

The defects have been considered to be caused by the fact that gas generated in the interior of the film or layer while the film or layer is hardening may be emitted to the atmosphere only from the surface of the film or layer.

Since a gas has the specific gravity smaller than that of the coating material constituting the film or layer, it tends to move through the film or layer toward the surface thereof. Accordingly, the gas is emitted from the surface of the film or layer to the atmosphere while the surface is relatively soft, i.e., has fluidity. However, when the surface is hardened with the passage of time to make the emission of the gas from the surface difficult, the gas moves toward the back which hardens later than the surface. This gas accordingly increases the internal pressure in the film or layer. However, since the back contacts the concrete base, the gas is not emitted to the atmosphere so that the internal pressure of the gas is further increased with the passage of time. The film or layer is exfoliated from the concrete due to the increase of the internal pressure to bring about the swelling phenomenon of blistering. Further, the gas having the increased internal pressure is forced to pass through the film or layer and slips out of the surface which has almost lost its fluidity, thereby leaving pinholes after the gas slips out of the surface.

SUMMARY OF THE INVENTION

An object of the present invention is to provide a base for a coating material made of synthetic resin, which may obviate defects such as pinholes or blisters.

The present invention is characterized in that the base for the material made of synthetic resin is formed of a porous plate. The plate according to the present invention is fixed to the concrete floor surface, floor surface on the roof, wall surface, etc. to provide the base for the coating material made of synthetic resin used for a material for finishing these surfaces.

In the base according to the present invention, a plurality of holes extend through the plate constituting the base to open to one or both surfaces thereof. The holes give spaces for the emission of gas produced in the interior of a film or layer when the coating material is applied to the outer surface of the plate and hardens. Thus, the occurrence of defects such as pinholes remaining after the gas slips out of the surface of the film or layer and blisters caused by the fact that the gas is accummulated between the film or layer and the concrete slab, for example, to bulge the surface due to the increase of the internal pressure may be prevented. Also, fillers may be applied to the surface of the plate, to which the coating material is applied, in order to prevent the coating material from flowing into and filling the holes opening to the surface or to reduce the flow of the coating material to save the same. Thereby, the opening area of the holes may be reduced.

The porous plate may be formed by molding a mixture of cement and liquid acrylic resin into a plate, for example. A plurality of holes in the plate are relatively fine and further extend in complicated relation with each other in the plate. Thus, when this plate is used, it almost dispenses with the fillers. Further, when the coating material is applied to the plate, the material hardens under the condition that the material does not extend through the holes, but intrudes halfway into the holes. The coating material which intrudes into the holes and then is hardened serves as anchor for the film or layer which is closely and firmly bonded to the plate. This fact also contributes to the prevention of the film or layer from exfoliation from the plate when slight earthquake force acts on the film or layer, for example.

Further, elasticity is given to the plate by the elasticity of the acrylic resin when hardened. The plate having the elasticity gives a relatively flat surface through elastic deformation when the plate contacts the concrete surface having irregularities as viewed microscopically. Further, the plate may be formed by molding a mixture of cement, liquid acrylic resin and reinforcement like glass fiber into a plate. The plate formed of this mixture improves the mechanical strength such as tensile strength, compressive strength or the like due to this reinforcement so that the plate is particularly suited for the base of a plastic finish required to prevent the surface of the plastic finish from cracking when shocks such as from walking are applied.

Also, the base according to the present invention is characterized in that a spacer having at least one hollow portion communicating to the holes in the plate is bonded to the plate.

According to the present invention, since the hollow portion in the spacer may substantially expand the gas emitting space defined by the holes in the plate, a greater amount of the gas may be more efficiently discharged.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
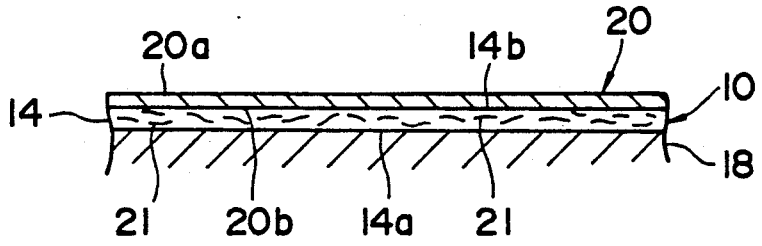
FIG. 1 is a longitudinal cross-sectional view showing a floor, to which a base consisting of only a plate is applied.
Figure 2:
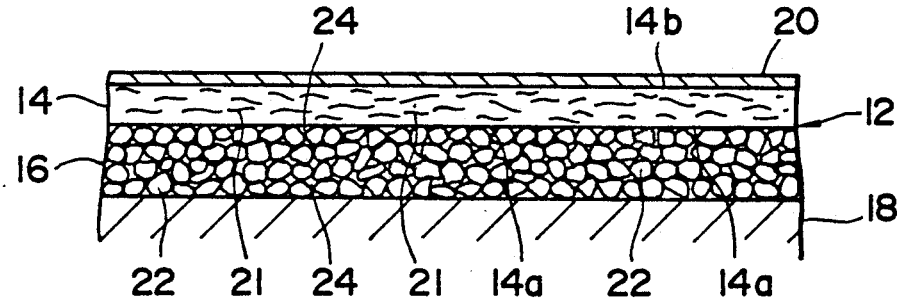
FIG. 2 is a longitudinal cross-sectional view showing the floor, to which a base consisting of the plate and a spacer is applied.

FIGS. 1 and 2 show respectively bases 10,12 according to the present invention.

The base 10 shown in FIG. 1 is constituted only from a porous plate 14 having a plurality of fine holes (not shown) opening to both surfaces. The base 12 shown in FIG. 2 is constituted from the plate 14 and a spacer 16 bonded thereto.

The bases 10,12 are bonded respectively through an adhesive to the concrete surface of a concrete slab 18 shown, concrete wall surface, surface of a roof floor (not shown) or the like, thereby forming a surface 14*b*, to which is applied coating material made of liquid synthetic resin such as urethane, epoxy or the like for finishing these surfaces.

Referring to FIG. 1, the plate 14 constituting the base 10 has one surface 14*a* bonded to the slab 18 and the other surface 14*b* to which the coating material is applied and formed into a film or a layer 20. The layer 20 may be formed by means of brushing, spraying or the like.

The layer 20 formed on the other surface 14*b* of the base 10 is hardened with the passage of time. This hardening process proceeds sequentially from the surface 20*a* of the layer 20 contacting the atmosphere toward the back 20*b* contacting the surface 14*b* of the base 10. During this process, gas is generated in the layer 20 and the internal pressure of the gas is increased as the amount of generated gas is increased. Since the gas has the specific gravity smaller than that of the layer 20, it moves toward the surface 20*a* of the layer to exhale from the surface 20*a* to the atmosphere while the surface 20*a* has relatively high fluidity gas permeability. However, after the surface 20*a* of the layer is hardened to block or make the emission of the gas difficult, the gas moves toward the back 20*b* of the layer which hardens later and thus has relativley higher fluidity.

A plurality of holes in the base 10 contacting the back 20*b* of the layer allow the gas to slip out of back 20*b* and flow into the holes. Accordingly, the emission of the gas from the surface 20*a* having the low fluidity compared with the back 20*b* is obviated to prevent the generation of pinholes surface 20*a* from the emission of the gas therethrough. Also, occurrence of blisters caused by the accumulation of the gas between the layer 20 and the slab 18 is prevented. The gas continuously flows into the holes until pressure in the holes generated by the flow of the gas into the holes is balanced with the internal pressure of the gas generated in the layer 20. The volume of the holes in the base 10, i.e., the capacity of receiving the gas is enlarged as the thickness of the plate is increased. Thus, the thickness of the base 10 is set according to the thickness of the layer 20 to be formed. Also, the respective holes in the base 10 may have a size such that the opening area in the other surface 14*b* may either block or permit the flow of the coating material into the holes. In the latter case when the opening area is relatively large, a filler material (not shown) consisting of a mixture of synthetic resin liquid and impalpable powder, for example, is applied to the base 10, i.e,. the other surface 14*b* of the plate 14 to reduce the opening area of the holes. By such filler application, the coating material is prevented from flowing into the holes and filling such holes. Also, when the holes are not completely filled by the coating material flowing into the holes, the flow of the coating material into the holes may be reduced by the filler so that the material may be saved.

The plate 14 may be obtained by molding a mixture (hereinafter referred to it as "mixture A") of a substance having a property of absorbing water content as it hardens, and a mixed liquid of water and synthetic resin liquid, for example, into a plate or by molding a mixture (hereinafter referred to it as "mixture B") of the mixture A with a reinforcement 21 into a plate.

For the substance having the property hardened by absorbing the water content, cement, plaster, lime, etc. for example is used. For liquid synthetic resin constituting the mixed liquid together with water, acrylic resin, vinyl acetate resin, etc. for example, is used. For the reinforcement 21, glass fiber, glass cloth, vinyl cloth, etc., for example is used.

Referring to an example of the components of mixture A and the weight ratio of the components, cement, and water and acrylic resin emulsion (50%) (mixed liquid) are in the ratio of 6 to 10. Also, referring to an example of the components of mixture B and the weight ratio of the components, cement, water and acrylic resin emultion (50%) (mixed liquid), and glass cloth (about 7 cm long) are in the ratio of 6 to 10 to 1.8.

The mixture A having these components and weight ratio thereof may be molded into a plate by the steps of laying flatly the mixture A with predetermined thickness on a relatively shallow box-like form having a rectangular bottom surface, for example (not shown), putting the form into a furnace and then blowing warm air to 60° to 90° C. temperature to the form. Time taken for heating the form in the furnace is preferably 2 to 3 hours in consideration of the atmospheric temperature when the warm air at 90° C. is blown. When the thickness of the molding obtained is relatively thin, for example 1 mm of less, the mixture A laid flatly on the form may be molded by being exposed to the sun about half a day.

Also, the mixture B having the components and weight ratio thereof is molded by the steps of laying thinly the glass cloth on the form and laying flatly the mixture A having the component ratio on the glass cloth. The glass cloth enters the mixture A due to pressure from mixture A to make the mixture B. The form with the mixture B laid flatly is put into the furnace and heated under the same conditions as the mixture A. When the thickness of the plate which is a molding of the mixture B is relative thin, the mixture B may be exposed to the sun under the same conditions as the mixture A.

Now, when the cement used in mixture A is mixed with the mixed liquid, molecules constituting respectively the cement and mixed liquid repel each other. By this repelling phenomenon a plurality of fine holes are formed which intersect each other through complicated passages i.e., knotty holes in the molding obtained when the mixture A or B is heated and hardened. The plurality of holes are opened to both the upper and lower surfaces of the molding with relatively uniform density. The repelling phenomenon of the molecules occurs also in the use of the plaster or lime instead of the cement.

The coating material applied to the molding, i.e., to the plate 14 intrudes only half way into the fine holes in the plate 14. Thus, the coating material intrudes into a plurality of fine holes like roots and then is solidified and firmly fixed to the plate 14, i.e., the base 10, so as to be less liable to exfoliate from the plate.

Also, elasticity is given to the plate 14 by the acrylic resin having the elasticity at the time of hardening. The concrete surface upon which base 10 is laid has a plurality of minute irregular portions. The respective convex portions abut against the surface 14*a* of the plate 14 so that the plate 14 is deformed elastically to have partial indents. Thus, the coated surface of the coating material may be made flat. In this case, the uniform thickness of the layer 20 or film may be obtained easily. The degree of the elasticity may be varied with a change in the mixed ratio of the cement and acrylic resin. The more the weight of acrylic resin relative to the cement is increased, the higher the elasticity of the plate 14.

Also, the plate 14 with no reinforcement 21 has a low mechanical strength; such as tensile strength, compressive strength or the like. The reinforcement 21 compensates for the mechanical strength of the plate 14. Thus, the plate 14 with no reinforcement 21 is suited for the decoration of wall surface, for example. On the other hand, the plate 14 with the reinforcement 21 is suited for the floor which is loaded with foot pressure or the like in walking. Of course, the plate 14 with the reinforcement 21 may be used in all portions of a building so that it can follow up the deformation of the building without producing any cracks or the like when the external force like earthquake force acts thereon. The plate 14, in addition to the example, may be formed of other kinds of porous materials such as blanket, open cell foamed plastic, layer of a plurality of granules 22 bonded to each other through spaces which will be later described.

Referring to FIG. 2, the base 12 is bonded to the slab 18 through the spacer 16 bonded to one surface 14*a*of the plate 14 and the layer 20 is formed on the other surface 14*b* of the plate. The spacer 16 has at least one hollow portion communicating to the fine holes in the plate 14, the hollow portion expands substantially a space defined by the holes in the plate 14 to emit the gas, while forming a path for emitting the gas to the atmosphere. Thus, a larger amount of the gas may be discharged more efficiently.

The spacer 16 may be formed of a layer of a plurality of granules 22 bonded to each other through spaces 24 which define the hollow portion.

For the granule 22 may be used rubber chip having elasticity, for example, or sand (particularly silica sand) with no elasticity, for example. Also, for the paste for bonding a plurality of granules 22 to each other may be used the mixture A, for example. Referring to the ratio of weight of the granules 22 and the mixture A, the granules and the mixture A are preferably in the ratio of 4 to 1. While a plurality of granules 22 are bonded to each other by the mixture A under the ratio, the spaces 24 defined by the granules 22 are not filled with the mixture A.

The base 12 having the spacer 16 may be formed by the steps of laying flatly a mixture (hereinafter referred to it as mixture C) of a plurality of granules 22 with mixture A having the weight ratio with predetermined thickness on the mixture A flatly laid as the form to form the plate 14 and then heating the mixtures under the same conditions as the case of molding the plate 14. In this case, since both paste for bonding a plurality of granules 22 of the spacer 16 and one of components of the plate 14 consist of the mixture A, the spacer 16 is firmly bonded to the plate 14.

The spacer 16 having the elastic granules 22 is elastically deformed to fill the space 24 with individual granules 22 at and around a spot receiving the external force like impact force through the layer 20 and plate 14. Thus, the spacer 16 has a cushion property. Hence, the base provided with the spacer having the cushion property is suited for a case when the coating material consisting of synthetic resin such as urethane resin having elasticity at the time of hardening, for example, is used, and provides a proper cushion property together with the layer of the coating material.

Also, the spacer having the granules 22 with no elasticity is not subjected to the elastic deformation when the external force acts on the spacer and thus does not have the cushion property. Therefore, the base provided with the spacer with no cushion property is suitable even for the use of the coating material consisting of synthetic resin having either elasticity or brittleness at the time of hardening. Particularly, in the case of the layer 20 made of epoxy resin having brittleness at the time of hardening, for example, the spacer in which a plurality of non-elastic granules support the layer at a plurality of points at small intervals is not deformed when the external force acts on the layer 20 so that cracks or the like are not produced in the layer.

Also, since the bases 10,12 may be manufactured in factories, the quality thereof may be maintained excellent and constant.

Figure 3:
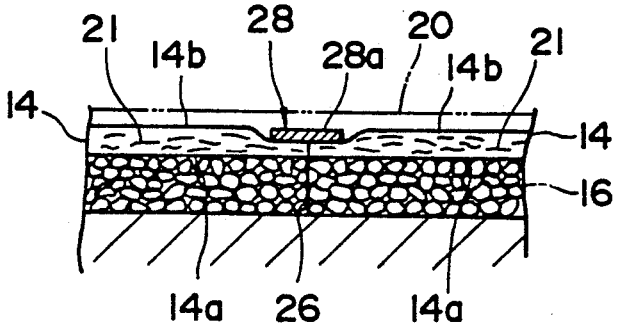
FIG. 3 is a longitudinal cross-sectional view showing the floor using two kinds of bases.

The bases 10,12 manufactured in the factories and having a predetermined shape, for example, a rectangular planar shape, are laid and disposed such that the edges thereof contact each other on the concrete surface, wall surface, roof floor surface, etc. Then, in order to prevent the coating material from flowing into joints 26 produced between the edges of respective bases as shown in FIG. 3, a porous strip 28, preferably a strip having the same components as plate 14 and molded into a strip, is disposed along the joint 26 to cover the same. To make the surface 28*a* of the strip 28 flush with the other surfaces 14*b* of the plates 14 at both sides of the strip, the thickness of the edge of the plate 14 is preferably formed thinner than that of other portions.

Further, in the execution, a plurality of bases 10,12 coated on the other surface 14*b* with the film or layer, to which the coating material is previously applied are furnished into the site of execution where the strip 28 is disposed such that the coating material may be applied only to the surface 28*a* of the strip and portions at both sides thereof.

Further, the bases 10,12 may be applied not only to the concrete surface, but also to all surfaces formed of other materials and needed to be finished with the application of synthetic resin. Also, in the case of the base 10 constituted only from the plate 14, a plurality of holes may be opened only to the surface, to which the coating material is applied, instead of the illustrated example in which the holes are opened to both surfaces of the plate 14.

I claim:

1. A multi-layered, surface covering and protecting composition for application to any desired surface, said composition comprising A) a first layer formed from a coating material comprising a. a first surface directly contacting the air b. a second surface directly contacting a second layer and c. a self hardening liquid synthetic resin further defined as 1. progressively hardening from the first surface to the second surface, and
2. generating a gas upon hardening; and B. a second layer comprising a substantially continuous, intermediate, porous, base
a. having a first surface positioned for intimate, contacting, supporting engagement with the second surface of the first layer,
b. having a plurality of holes extending from said first surface for receiving at least some of the gas generated by the liquid synthetic resin of the first layer, thereby preventing pinholes or blisters from being formed between the first layer and the second layer; and
c. being formed by molding a mixture comprising
i. a substance having a property of hardening by absorbing water; and
ii. liquid synthetic resin and water, said mixture being heated at an elevated temperature ranging from between about 60 to 90 degrees centigrade whereby a highly effective, multi-layered, surface covering and protecting composition is attained for application to any desired support surface for imparting a secure protective covering thereto.

2. A base as claimed in claim 1, wherein said substance and synthetic resin are respectively made of cement and acrylic resin.

3. A base is claimed in claim 2 wherein the cement and synthetic resin are in the weight ratio of 6 to 10.

4. A base as claimed in claim 1, wherein said substance and synthetic resin are respectively made of plaster and acrylic resin.

5. A base as claimed in claim 1, wherein the substance and synthetic resin are in the weight ratio of 6 to 10.

6. A base as claimed in claim 1, wherein said mixture further comprises a reinforcement.

7. A base as claimed in claim 6, wherein the reinforcement comprises glass fibers.

8. A base as claimed in claim 6, wherein the substance and liquid synthetic resin mixed with water are in the weight ratio of 6 to 10.

9. A base as claimed in claim 6, wherein the substance, liquid synthetic resin mixed with water, and reinforcement are in the right ratio of 6 to 10 to 1.8.

10. A multi-layered, surface covering and protecting composition for application to any desired surface, said composition comprising A) a first layer formed from a coating material comprising
a. a first surface directly contacting the air
b. a second surface directly contacting a second layer and
c. a self hardening liquid synthetic resin further defined as
1. progressively hardening from the first surface to the second surface, and
2. generating a gas upon hardening;

B. a second layer comprising a substantially continuous, intermediate, porous, base
a. having a first surface positioned for intimate, contacting, supporting engagement with the second surface of the first layer,
b. having a second surface opposite said first surface,
c. having a plurality of holes extending from said first surface for receiving at least some of the gas generated by the liquid synthetic resin of the first layer, thereby preventing pinholes or blisters from being formed between the first layer and the second layer, and
d. being formed by molding a mixture comprising
i. a substance having a property of hardening by absorbing water, and
ii. liquid synthetic resin and water, said mixture being heated at an elevated temperature ranging from between about 60° to 90° degrees centigrade; and c. a third layer comprising granules having a first surface adjacent to the second surface of said second layer and having a plurality of second holes which open on said second surface of said second layer to receive said gas having passed through said first holes of the second layer.

11. A base as claimed in claim 10, wherein said substance and synthetic resin are respectively made of cement and acrylic resin.

12. A base as claimed in claim 10, wherein said substance and synthetic resin are respectively made of plaster and acrylic resin.

13. A base as claimed in claim 10, wherein said granules are made of sands.

14. A base as claimed in claim 10, wherein said granules are made of rubber chips.

15. A base as claimed in claim 10, wherein said mixture further comprises a reinforcement.

16. A base as claimed in claim 15, wherein the reinforcement comprises glass fibers.

17. A base as claimed in claim 15, wherein the substance, liquid synthetic resin mixed with water, and reinforcement are in the right ratio of 6 to to 1.8.

18. In combination, a base and a layer of coating material having a surface directly contacting the air and a surface directly contacting the base, the layer is made of liquid synthetic resin which hardens from the surface thereof contacting the air toward the surface contacting the base and generates gas as the resin hardens, said base comprising a porous plate having one surface to which said coating material is applied and having a plurality of holes opening on at least said one surface so as to receive at least some of the gas generated by the liquid synthetic resin as the resin hardens so as to prevent pinholes from being formed in the resin and to prevent the resin from blistering, said plate being formed by molding a mixture comprising:

A) a substance having a property of hardening by absorbing water; and
B) liquid synthetic resin and water, said mixture heated at an elevated temperature ranging from between about 60° to 90° degrees centigrade; said coating material passing partially through the plurality of holes in said base and hardening in the course of entering the holes, so that the coating material is anchored to the plate whereby it is difficult for the coating material covering the surface of the plate to be peeled from the plate.

19. In combination, a base and a layer of coating material having a surface directly contacting the air and a surface directly contacting the base, the layer is made of liquid synthetic resin which hardens from the surface thereof contacting the air toward the surface contacting the base and generates gas as the resin hardens, the base comprising:

A) a porous plate having one surface to which said coating material is applied and having a plurality of first holes passing through said plate for receiving gas generated from said coating material during hardening, said plate being formed by molding a mixture comprising:

i. a substance having a property of hardening by absorbing water, and ii. liquid synthetic resin and water, said mixture heated at an elevated temperature ranging from between about 60° to 90° degrees centigrade, said coating material passing partially through the plurality of holes in said base and hardening in the course of entering the holes, so that the coating material is anchored to the plate thereby making it difficult for the coating material covering the surface of the plate to be peeled from the plate; and B) a layer of granules having one surface adjacent to the other surface of said plate and having a plurality of second holes which open on said one surface of said layer to receive said gas having passed through said first holes of the plate.

* * * * *